US005950814A

United States Patent [19]

Lindberg et al.

[11] Patent Number: 5,950,814

[45] Date of Patent: Sep. 14, 1999

[54] CLOSED SPECTACLE CASE

[75] Inventors: Henrik Lindberg, Aarhus; Poul Jørn Lindberg, Egaa, both of Denmark

[73] Assignee: Lindberg Optic Design A/S, Aabyhou, Denmark

[21] Appl. No.: 08/948,153

[22] Filed: Oct. 9, 1997

Related U.S. Application Data

[63] Continuation-in-part of application No. PCT/DK96/00041, Jan. 24, 1996, abandoned.

[30] Foreign Application Priority Data

Apr. 21, 1995 [DK] Denmark ..... 0472/95

[51] Int. Cl.[6] ..... A45C 11/04

[52] U.S. Cl. ..... 206/6; 220/837

[58] Field of Search ..... 206/5, 6; 220/839, 220/837; 229/126; 383/86; 150/119

[56] References Cited

U.S. PATENT DOCUMENTS

| | | | |
|---|---|---|---|
| 677,785 | 7/1901 | Mariner | 206/6 |
| 677,904 | 7/1901 | Threehouse | 206/6 |
| 903,737 | 11/1908 | Lembcke . | |
| 1,955,613 | 4/1934 | Theilengerdes | 206/5 |
| 2,148,637 | 2/1939 | Oldham | 206/6 |
| 2,793,741 | 5/1957 | Jerry | 206/6 |
| 2,863,487 | 12/1958 | Shiner | 206/5 |
| 2,909,276 | 10/1959 | Stegeman | 206/5 |
| 5,526,924 | 6/1996 | Klutznick | 206/5 |
| 5,711,417 | 1/1998 | Tilve | 206/6 |

FOREIGN PATENT DOCUMENTS

| | | |
|---|---|---|
| 1045535 | 11/1953 | France . |
| 1313228 | 11/1962 | France . |
| 1295771 | 5/1969 | Germany . |

*Primary Examiner*—Paul T. Sewell
*Assistant Examiner*—Luan K. Bui
*Attorney, Agent, or Firm*—Thomas R. Vigil

[57] ABSTRACT

A spectacle case (1) consists of two lateral elements (6) and an enveloping element (11) made of an elongated sheet of thin, resilient material having at its one end a section which is bent into cylinder sector form to constitute an end surface (5) of the case, a planar or slightly curved section which forms the bottom (8), a section which has been bent into cylinder sector form to constitute a second end surface (4), a planar or slightly curved section which forms the cover surface (10) and a section at the opposite end of the elongated sheet which has been bent into cylinder sector form to constitute a hooked locking means (9). The two lateral elements are permanently joined with those portions of the elongated sheet which constitute the bottom and the two end surfaces and brace these sections whereby they provide a solid bottom portion of the case. The unbraced portion forms a resilient cover (3) of the case.

11 Claims, 2 Drawing Sheets

CLOSED SPECTACLE CASE

CROSS-REFERENCE TO RELATED APPLICATIONS

This is a continuation-in-part of international application PCT/DK96/00041 with an international filing date of Jan. 24, 1996, now abandoned.

This application is based on application No. 0472/95 filed in Denmark on Apr. 21, 1995, the contents of which are incorporated hereinto by reference.

FIELD OF THE INVENTION

The present invention relates to a spectacle case.

A spectacle case of this type is used for holding a folded pair of spectacles to protect said spectacles against mechanical damage and any dust or the like when not in use. Depending on the relevant requirements made to the spectacle cases in use, they may be designed to provide different degrees of mechanical protection and to exhibit varying degrees of dimensional stability.

The present invention relates to spectacle cases which possess the minimum dimensional stability required to establish and maintain closure between the cover element and the bottom element. However, this does not preclude such spectacle cases from still possessing a considerable degree of flexibility, a property which may be useful for some applications and which is acceptable in particular in connection with the holding of spectacles which are elastic and consequently tolerate a certain degree of deformation.

THE PRIOR ART

FR-A 1 045 535 teaches a spectacle case having a bottom element, a cover element, a hinge and a locking means designed to secure the cover element to the bottom element in the closed position of the case. The cover element and the bottom element in this spectacle case is composed of rigid components connected by means of the hinge which is provided by a strip of skin. The locking means comprises a latch.

SUMMARY OF THE INVENTION

The invention provides a spectacle case comprising a bottom element, a cover element, resilient means connecting said cover element to said bottom element in a pivotable manner so as to allow said elements to pivot between a closed position in said resilient means is tensioned, while said bottom element and said cover element provide a spatially enclosed, protective space, and an open position in which said resilient means is relieved and it is possible to access a pair of spectacles into or removing a pair of spectacles from said case, and releasable locking means designed to secure said cover element against said bottom element in the closed position, wherein said resilient means connecting said cover element to said bottom element is implemented in the form of an element which gradually and without any abrupt transitions extends into said bottom element and into said cover element, and by said cover element comprising a first substantially rectilinear reinforcement at the point where it meets said bottom element, and a second substantially rectilinear reinforcement opposite said substantially rectilinear reinforcement and substantially parallel therewith and a web of flexible material extending between said two reinforcements.

The hinge function being integral with the cover, the invention provides a particularly simple construction since it eliminates the need for a separate hinge mechanism. Moreover, an elegant design is obtained as well as a convenient opening function which does not involve the risk of the spectacles unintentionally falling out during opening.

The cover element comprises a first substantially rectilinear reinforcement at the zone where it meets the bottom element, a second substantially rectilinear reinforcement opposite the first one and substantially parallel with the first one as well as an elongated sheet of a resilient material extending between the two reinforcements. By providing the cover element with two rectilinear reinforcements in this manner the flexing course of the cover element during opening and closing will be controlled as the cover will perform a uniaxial curving, i.e. will follow every shape assumed during opening or closing a surface whose generatrix are parallel with the rectilinear reinforcements. This movement pattern is maintained in all conditions, including point loading, e.g. when the case is closed by fingers or if the locking means is provided with spot securing.

According to a preferred embodiment the first reinforcement may be realised in the form of a bend which may be angular or rounded. The reinforcement in this embodiment does not require additional material, use being made of the cover material proper since, due to its geometry, bending generates a rectilinear reinforcement. However, this does not preclude alternative realisations of the first reinforcement, e.g. by means of a corrugation in the cover surface or by securing the cover to a reinforcement portion of the bottom element. Parallel use of combinations of these reinforcement methods is also an option.

Similarly, the second reinforcement of the preferred embodiment is realised as a bend so as to exploit the cover material whereby the need for further material is eliminated. The bend may be angular or rounded. Of course, the second reinforcement may also be supplemented with or realised in the form of a corrugation in the cover material or it may comprise a separate reinforcement element.

According to a preferred embodiment, the bend which constitutes at least a portion of the second reinforcement, extends so far that it may engage with the corresponding end of the bottom element and secure the cover element in a releasable manner. This embodiment utilizes the flexing properties of the resilient element which is integral with the cover element for the locking means so as to obtain a particularly simple solution. This embodiment of the locking means presents a particular advantage in tolerating a substantial degree of twisting and bending of the case, the mutually engaging portions of the cover element and of the bottom element being able to slide mutually along a direction parallel to the generatrices of the bends without losing the locking engagement.

Other embodiments may be provided with a separate locking means at the outermost portion of the cover and in these cases, the cover does not need to be provided with a bent hooking edge.

According to a preferred embodiment the bottom element comprises two lateral edges which extend from the area in which the cover element meets the bottom element and to the area which is immediately below the second rectilinear reinforcement in the closed position of the cover, the cover according to this embodiment being so designed that, in its closed position, it abuts on the two lateral edges with spring loading substantially continuously along the entire periphery of the elements. Such continuous, flexible abutment ensures that no slits occur in the case in its closed state whereby complete closure is ensured.

According to a preferred embodiment the case is composed of two lateral elements and an elongated sheet of thin flexible material having at its one end a section bent into the form of a cylinder sector to constitute the end surface opposite the connecting portion, a planar or slightly curved section which forms the bottom, a section bent into cylinder sector form to constitute the end surface and the first reinforcement at the connecting area, a planar or slightly curved section which forms the cover plane, and a section at the opposite end of the elongated sheet which is bent into cylinder sector form to constitute the locking means and the second reinforcement, the two lateral elements being permanently joined with those portions of the elongated sheet which form the bottom and the two end surfaces, respectively, and being provided with edges which form abutment surfaces to support the cover portion in the closed position. This embodiment allows the case to be assembled from a total of three components, viz. two identical lateral elements and an elongated sheet of a thin, resilient material.

The lateral elements may be connected to the elongated sheet material by glueing, welding or structural engagement, and they serve to brace the corresponding portions of the elongated sheet material so as to permit that those portions of the case which are, during use, perceived as rigid are in fact partially constituted of exactly the same resilient elongated sheet material as the portion, viz. the cover, which is perceived as completely flexible. Hereby a convenient solution and an elegant appearance of the case are obtained.

The invention also provides a spectacle case a spectacle case comprising two lateral wall elements and an elongate sheet of thin, resilient material delimited by a first transverse edge, a second transverse edge and two longitudinal edges, said sheet comprising a first section adjacent said first transverse edge, which is curved into a cylinder sector form in order to provide a first end wall, a second section adjacent said first section, which is planar or slightly arched in order to provide a bottom wall element, a third section adjacent said second section, which is curved into a cylinder sector form in order to provide a second end wall and a first reinforcement, both situated opposite said first end wall, a fourth section adjacent said third section, which is planar or slightly arched in order to provide a cover wall element, and a fifth section adjacent said fourth section, which is curved into a cylinder sector form in order to provide a releasable locking means and a second reinforcement, said two lateral wall elements being permanently joined with those portions of said sheet, which provide said bottom wall element and said two end walls, while those portions of said sheet, which provide said cover wall element and said locking means are free to flex between a locked position, wherein said locking means is engaged and said lateral walls together with said sheet provide a substantially closed container, and an open position, wherein said locking means is disengaged and said cover wall element opened to permit access to the interior of said container.

The invention will now be explained in further detail with reference to the exemplary embodiment illustrated in the drawings.

DETAILED DESCRIPTION OF THE PREFERRED EMBODIMENTS

Figure 1:
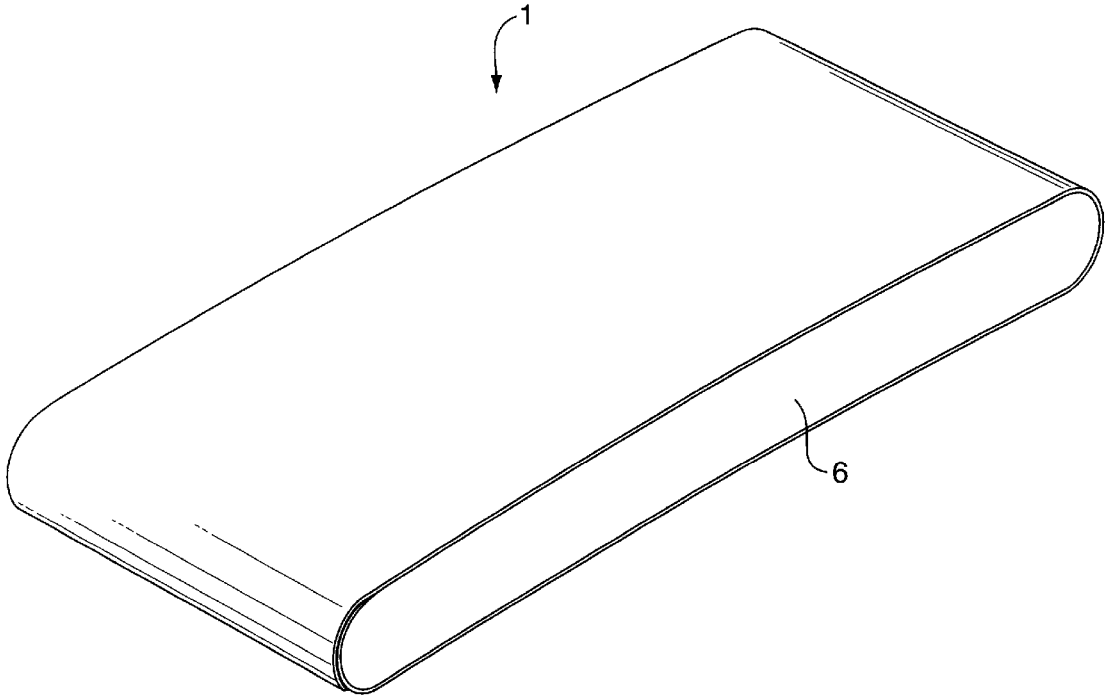
FIG. 1 is a perspective view of a spectacle case according to the invention in its closed state.

All figures are schematical and not necessarily to scale and they illustrate only elements necessary to understand the invention whereas other elements have been omitted for the sake of clarity. Identical reference numerals are used in all figures to designate identical or corresponding elements.

Figure 2:
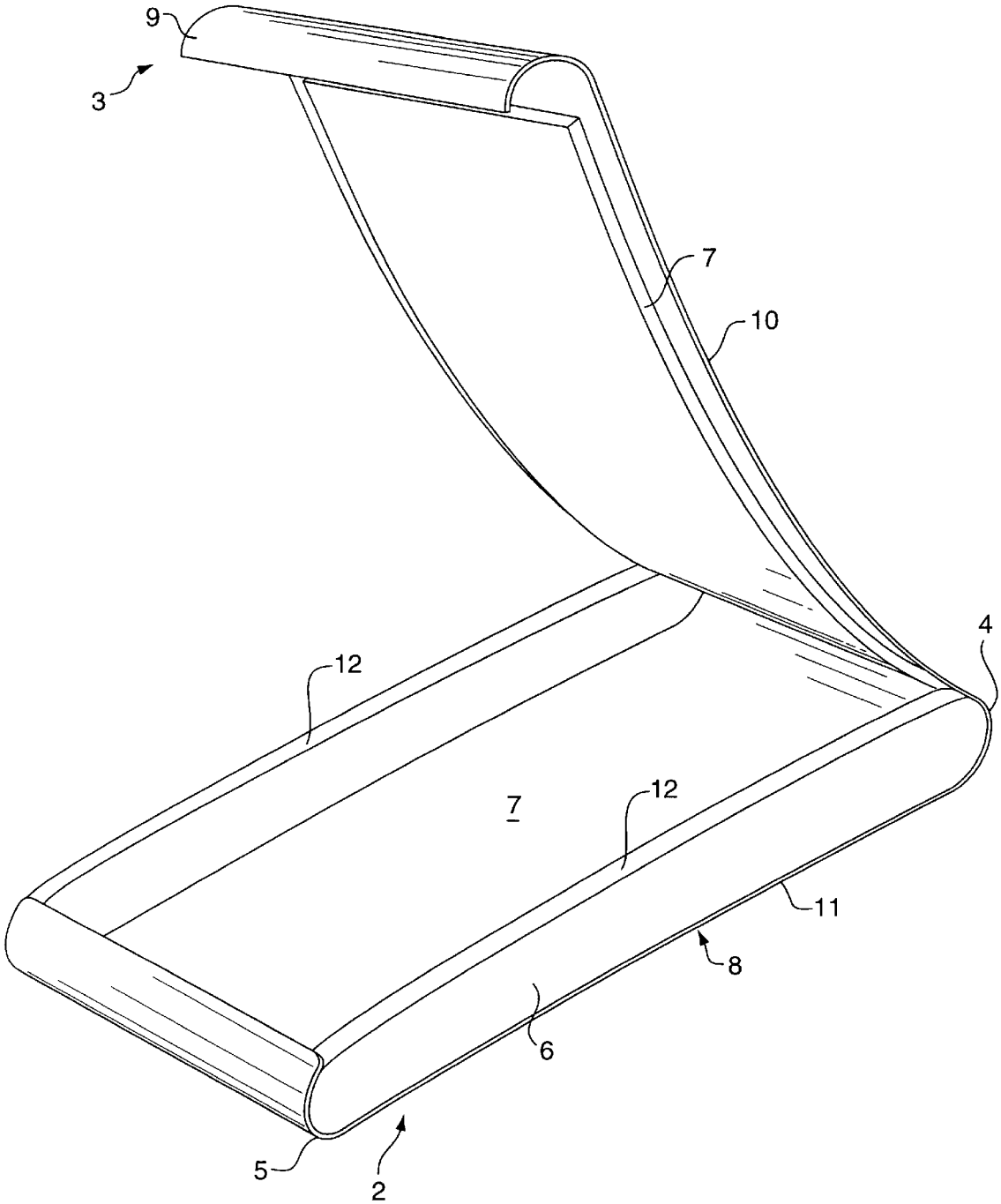
FIG. 2 illustrates the case shown in FIG. 1 in its open state.

The case unit shown in the figures, reference being made in particular to FIG. 2, is designated by the reference numeral 1, and it comprises a bottom 2 and a cover 3. Essentially, the bottom 2 forms an upwardly open box delimited by a bottom plane 8, two lateral elements 6, an end plane at the hinge area 4 and an end plane opposite the hinge area 5. The opening of this box-like construction is substantially sealingly closed by means of the cover 3, the closed position of which being illustrated in FIGS. 1 and 3.

Although the term "hinge area" is used herein, it is to be understood that the case according to the invention does not comprise an actual hinge. The portion bent during the closing operation is not strictly delimited but comprises the major part of the cover 3 which is bent to varying degrees, the most acute bending being effected close to the hinge area 4 while the bending of the remainder of the cover decreases in pace with the distance from the hinge area.

Figure 3:
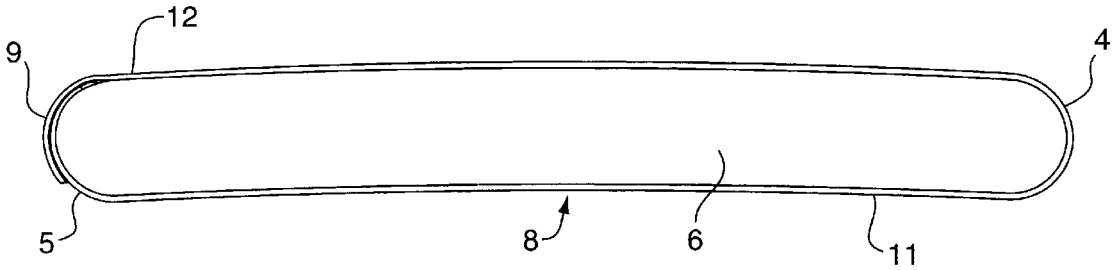
FIG. 3 is a side view of the case shown in FIG. 1 in its closed state.

According to a preferred embodiment, the two identical lateral elements may comprise oval plates cut from plastics or the like material to the shape illustrated in FIG. 3. The remainder of the case may be made of essentially one single elongated sheet of a resilient material which is bent to form an envelope element 11 by bending of a section near the one end of the elongated sheet about an appr. 180° cylinder sector to form the end surface opposite the hinge area 5, a bordering section being slightly curved to form the bottom plane 8, a section is bent appr. 180° to form the end surface at the hinge area 4, a section being curved upwards to form the cover surface 10 which arches upwards when not restrained (cf. FIG. 2) and the last section being bent appr. along 135° of a cylinder sector to form the bent hooking edge 9 of the cover, i.e. a bend which serves as an engagement hook and secures the cover by engagement with the end planes of the bottom opposite the hinge area 5.

The arched shape of the cover when unrestrained implies that essentially any cross section of the cover from the end surface at the hinge area to the hooking edge will be subjected to a bending moment when the cover is closed. These bending moments cause the cover to be pressed against the edges of the lateral elements. The arched shape of the cover is preferably matched to ensure a generally even contact pressure along the edges of the lateral elements. The lateral elements of the preferred embodiment are connected by glueing to those areas of the enclosure element which constitute the end surface opposite the hinge area 5, the bottom 8 and the end surface at the hinge area 4. The lateral elements brace the adhered portions of the enclosure element so as to form a substantially rigid box which constitutes the bottom element 2 of the case.

In other embodiments the bends may be polygonal or rectangular since the rectilinear reinforcement according to the invention may be realised by any type of bend that has rectilinear generatrices. As mentioned, the rectilinear reinforcements may also be realised in the form of corrugations or by fitted reinforcement elements whereby the envelope element is allowed to have other designs.

The insides of the case are conveniently provided with a padding 7 or alternatively a moulded insert may be inserted to hold and support the spectacles to be contained therein.

According to another embodiment the insert may be designed integrally with lateral elements which replace the lateral elements 6 described above. The envelope element may be made of stainless steel having a dimension within the range of 0.2–0.6 mm, in particular having a thickness of 0.3–0.5 mm. The dimensions of the assembled case are routinely adapted to the dimensions of the spectacles to be contained therein.

Although having a rectangular shape with the cover connected at the one short side edge, it is to be understood that the cover of the case according to the invention could also be provided in other embodiments, e.g. with cover connection at an elongated side edge and it may optionally have other shapes than rectangular.

The case assembly distinguishes itself being elegant and in possessing convenient handling properties. The case is easily closed by light squeezing of the cover and bottom in the vicinity of the bent hooking edge of the cover, and it is opened by upward pushing of the outermost rim of the cover's bent hooking edge while the bottom is held by pressure onto the lateral elements.

Although specific embodiments of the present invention have been described above, it is to be understood that the invention is not limited to comprise such embodiments and that it is defined exclusively by the scope of the appended patent claims.

What is claimed is:

1. A spectacle case comprising a bottom element, a cover element, connecting means connecting said cover element to said bottom element in a pivotable manner so as to allow said elements to pivot between a closed position in which said cover element provides a spatially enclosed, protective space, and an open position in which it is possible to access a pair of spectacles into or to remove a pair of spectacles from said case, and releasable locking means designed to secure said cover element against said bottom element in the closed position, said connecting means comprising a sheet element shaped to extend gradually and without any abrupt transitions between said bottom element and said cover element, and said cover element comprising a first bend at the point where it meets said bottom element, a second bend spaced from said first bend and substantially parallel therewith and a web of flexible material extending between said first bend and said second bend, which web is resilient in bending and constructed and arranged to be resiliently biased on closing said case and to be relieved on opening of said case.

2. The spectacle case according to claim 1, wherein said first bend is shaped substantially as a sector of a cylinder.

3. The spectacle case according to claim 1, wherein said second bend is shaped substantially as a sector of a cylinder.

4. The spectacle case according to claim 3, wherein said second bend is constructed and arranged for selective engagement with an adjacent portion of said bottom element in order to secure said cover element in a releasable manner.

5. The spectacle case according to claim 1, wherein said bottom element comprises two lateral edges which extend from the area where said cover element meets said bottom element and to the area which is immediately below said second bend in the closed position of said cover, and wherein said cover is constructed and arranged to abut, while in its closed position, on said two lateral edges with spring loading substantially continuously along the course of said lateral edges.

6. The spectacle case according to claim 1, wherein said web is implemented in the form of a sheet element which gradually and without any abrupt transitions extends into said bottom element and into said cover element.

7. A spectacle case comprising two lateral wall elements and an elongate sheet delimited by a first transverse edge, a second transverse edge and two longitudinal edges, said sheet being shaped to provide a first section adjacent said first transverse edge, which is curved into a cylinder sector form in order to provide a first end wall, a second section adjacent said first section, which is planar or slightly arched in order to provide a bottom wall element, a third section adjacent said second section, which is curved into a cylinder sector form in order to provide a second end wall, said second end wall being situated opposite said first end wall, a fourth section adjacent said third section, which is planar or slightly arched in order to provide a cover wall element, and a fifth section adjacent said fourth section, which is curved into a cylinder sector form in order to provide a releasable locking means, said sheet comprising a thin material which is resilient in bending, and said two lateral wall elements being permanently joined with those portions of said sheet which provide said bottom wall element and said first end wall and said second end wall, while those portions of said sheet which provide said cover wall element and said locking means, are free to flex between a locked position, wherein said locking means is engaged, and an open position, wherein said locking means is disengaged.

8. The spectacle case according to claim 7, wherein said lateral wall elements comprise lateral edges formed to provide abutment and sealing surfaces, seating said cover wall element, while in the locked position.

9. The spectascle case according to claim 8, wherein said cover wall element is formed to engage said abutment and sealing surfaces with resilient force, substantially along the entire length of said cover wall element.

10. The spectacle case according to claim 7, wherein said lateral wall elements comprise plates cut from plastic material.

11. The spectacle case according to claim 7, wherein said lateral wall elements are bonded to said first section, to said second section and to said third section of said sheet.

* * * * *

UNITED STATES PATENT AND TRADEMARK OFFICE

CERTIFICATE OF CORRECTION

PATENT NO. : 5,950,814

DATED : September 14, 1999

INVENTOR(S) : Henrik Lindberg et al.

It is certified that error appears in the above-indentified patent and that said Letters Patent is hereby corrected as shown below:

On the Title Page: " [73] Assignee: Lindberg Optic Design A/S, Aabyhou, Denmark"

should be -- [73] Assignee: Lindberg Optic Design A/S, Aabyhoj, Denmark--;

Column 3, line 29, delete "a spectacle case" 2nd occurence;

Column 6, line 43, "spectscle" should be --spectacle--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*